US007386094B2

(12) United States Patent
Saint-Martin et al.

(10) Patent No.: US 7,386,094 B2
(45) Date of Patent: Jun. 10, 2008

(54) RADIATION EMISSION DEVICE HAVING A BEARING AND METHOD OF MANUFACTURE

(75) Inventors: Thomas Saint-Martin, Limours (FR); Thierry Godart, Bonnelles (FR); Jean-Marie Penato, Les Essarts le Roi (FR); Frédéric Dahan, Le Chesnay (FR)

(73) Assignee: General Electric Company, Schenectady, NY (US)

( * ) Notice: Subject to any disclaimer, the term of this patent is extended or adjusted under 35 U.S.C. 154(b) by 160 days.

(21) Appl. No.: 11/312,037

(22) Filed: Dec. 20, 2005

(65) Prior Publication Data

US 2006/0133578 A1 Jun. 22, 2006

(30) Foreign Application Priority Data

Dec. 21, 2004 (FR) ..... 04 53131

(51) Int. Cl.
*H01J 35/00* (2006.01)
*H01J 35/10* (2006.01)

(52) U.S. Cl. ..... 378/133; 378/144

(58) Field of Classification Search ..... 378/121–144
See application file for complete search history.

(56) References Cited

U.S. PATENT DOCUMENTS 1,635,524 A * 7/1927 Aikman ..... 417/53
1,657,769 A * 1/1928 Scrannage ..... 123/196 A
1,929,936 A * 10/1933 Slagel ..... 62/194
2,067,924 A * 1/1937 Illsley ..... 137/508
2,494,534 A * 1/1950 Armstrong et al. ..... 210/130
3,342,086 A * 9/1967 Borman et al. ..... 408/59
4,019,534 A * 4/1977 Clements et al. ..... 137/614.18
4,622,687 A * 11/1986 Whitaker et al. ..... 378/130
4,674,109 A * 6/1987 Ono ..... 378/130
4,768,558 A * 9/1988 Weber ..... 137/862
5,077,781 A * 12/1991 Iversen ..... 378/200
5,291,750 A * 3/1994 Parrish et al. ..... 62/259.3
5,357,555 A * 10/1994 Gerth ..... 378/200
5,595,462 A * 1/1997 Hensley ..... 409/132
5,668,849 A 9/1997 Sugiura et al.
5,826,469 A * 10/1998 Haradem ..... 82/1.11
5,995,584 A * 11/1999 Bhatt ..... 378/125
6,426,998 B1 * 7/2002 Hell et al. ..... 378/141
7,064,472 B2 * 6/2006 Pelrine et al. ..... 310/324

(Continued)

FOREIGN PATENT DOCUMENTS

EP 0 479 195 A 4/1992

*Primary Examiner*—Edward J. Glick
*Assistant Examiner*—Anastasia Midkiff
(74) *Attorney, Agent, or Firm*—Cantor Colburn LLP

(57) ABSTRACT

A valve is provided to fill a chamber for holding a rotation shaft of a rotating anode in an X-ray tube. The valve has a needle supported on a seat. The needle maintains the vacuum in the tube. A sleeve can engage in the valve. The sleeve is hollow and has a cavity. This cavity can be connected to the vacuum or to a bottle under vacuum filled with a lubricant liquid. The sleeve is used to handle the needle. The sleeve furthermore bears on a rim of the valve by an O-ring joint. This joint maintains the vacuum when the needle is raised and when the tube under vacuum is connected to the cavity of the sleeve.

17 Claims, 3 Drawing Sheets

U.S. PATENT DOCUMENTS 7,127,033 B2 * 10/2006 Lovoi et al. ..... 378/130
2002/0085676 A1 * 7/2002 Snyder ..... 378/130
2003/0214199 A1 * 11/2003 Heim et al. ..... 310/309
2005/0117706 A1 * 6/2005 Powell ..... 378/141
2007/0164641 A1 * 7/2007 Pelrine et al. ..... 310/800

* cited by examiner

RADIATION EMISSION DEVICE HAVING A BEARING AND METHOD OF MANUFACTURE

CROSS-REFERENCE TO RELATED APPLICATIONS

This application claims the benefit of a priority under 35 USC 119(a)-(d) to French Patent Application No. 04 53131 filed Dec. 21, 2004, the entire contents of which are hereby incorporated by reference.

BACKGROUND OF THE INVENTION

An embodiment of the present invention is a radiation emission device, in particular, a rotating-anode X-ray tube with improved bearing and a method for its manufacture. An embodiment of the present invention can be used in medical imaging and also in the field of non-destructive controls when high-powered X-ray tubes are used.

In radiology, such X-rays are produced by an electron tube provided with an anode rotating on a shaft. A powerful electrical field created between the cathode and the anode causes electrons emitted by the cathode to strike the anode, generating X-rays. For this X-ray emission, the positive polarity is applied to the anode by its shaft, and the negative polarity is applied to the cathode. The unit is insulated, especially by dielectric pieces or by an enclosure of the electron tube. This enclosure can be partly made of glass.

When the tube is high-powered, the impact of the electrons on the anode has the effect of abnormally heating this anode. If the power is excessively high, the emitter track of the anode may get deteriorated and pitted with impact holes. To prevent such overheating, the anode is made to rotate so that a constantly renewed and constantly cold surface is presented to the electron stream.

A motor of the tube therefore drives the shaft of the anode freely in a mechanical bearing. This shaft is located in an anode chamber. The anode chamber is itself formed in a support of the anode. On the one hand, the bearing is held by the anode support and, on the other hand, it holds the shaft of the anode.

In practice and when made on an industrial scale, this bearing has classic ball bearings as opposed to the little-used magnetic bearings. The problem posed by the rotating anode arises from the fast wearing out of the metal coating the balls during the rotation of the shaft in the bearing. The service lifetime is then about 100 hours, giving a period of use of the tube of about six months to one year. To overcome this problem, it has been proposed to coat the balls of the bearing with metal, lead or silver in the form of a thin layer. To reduce this premature wearing out of the metal layer, in the known art, a lubricant film is placed at the interface between the surfaces of the ball bearings and the shaft, between the bearing and the shaft of the anode. To this end, the interior of the chamber is filled with a gallium-indium-tin based liquid. Such a liquid is chosen because it improves the coefficient of friction, reduces the noise of the impacts between the balls and augments heat transfer through the heating of the shaft from the anode to the fixed part, either by convection or by conduction. Other lubricant liquids are not chosen because they have poor degassing properties.

The use of the gallium-indium-tin based alloy has proved to be a source of difficulty. Indeed, this alloy, which is liquid at ambient temperature (starting from 10 degrees Celsius), gets oxidized very quickly in contact with air. This oxide is solid and takes the form of a surface film within a very short time of about one to two minutes. This means that the handling of such a liquid in industrial conditions has to be done with certain precautions, in a neutral atmosphere or under vacuum. Besides, this film has no lubricating quality, indeed far from it. Gallium is furthermore highly corrosive. If this mixture were to be handled, even in the laboratory, liquid could get spilt or could leak or overflow, giving rise to puddles or deposits on the handling surface. It is then extremely difficult to remove all these puddles or deposits in a white room, especially in a system under manufacture (in the enclosure of the tube). Indeed, if a stain is wiped off, it reappears within a few seconds in the form of another brownish stain at the position that has been just (but not completely) cleaned. The state of the room is then not propitious to the requirements of quality manufacturing.

The difficulties then are of two types: the handling of the alloy itself in the laboratory or plant, and its mode of insertion under vacuum into the bearing during the manufacture of the tube. Furthermore, the purity of this liquid, despite its contribution to the lubrication of the bearing in association with the balls of the bearing, may deteriorate in the course of time and finally, as in the case of the coating of the balls, it may cease to have any effect.

In current and future radiology, the power need by electron tubes are increasing in order obtain improved diagnosis. This increase in power is increasing the weight of the anode to six-eight kilograms. The resulting effects within the bearing are becoming critical. Furthermore, for use in computerized tomography with continuous rotation at two rotations per second, the bearing is subjected to acceleration of about eight G. Rotation speeds of three to four rotations per second are anticipated. As a consequence, the service life of the bearing, and therefore of the tube, with the balls and the liquid, may be limited in time. Indeed, the liquid may lose its properties and therefore its qualities as and when heating and friction occur inside the bearing.

BRIEF DESCRIPTION OF THE INVENTION

An embodiment of the invention is a radiation emission device, such as an X-ray tube comprising an enclosure in which X-rays are produced. Disposed in the enclosure are a cathode, a rotating anode facing the cathode and rotating on a shaft, and an anode shaft support, the support comprising a chamber for holding the anode shaft. The chamber has means for filling or pumping, such as a channel or hole or aperture, to enable the chamber to be filled with or drained of a lubricant fluid. The channel or hole aperture is provided with an embedded valve comprising a plugging needle capable of shifting in the hole. A removable sleeve getting is secured to the needle, the sleeve being hollow and being provided with means to handle the needle, the sleeve being provided with an O-ring joint and/or the needle being provided with a peripheral joint.

An embodiment of the invention is a method for placing a lubricant liquid in the chamber of a radiation emission device, such as an X-ray tube. The method comprises engaging the sleeve in the needle; the joint of the sleeve being applied against the wall of the hole or aperture. A vacuum is set up in a cavity of the needle connected to a cavity of the sleeve while the sleeve is applied. The sleeve is handled again to move the needle away from the channel or hole or aperture, and a lubricant fluid is made to flow under vacuum into the chamber through the two mutually connected cavities of the sleeve and the needle.

BRIEF DESCRIPTION OF THE DRAWINGS

An embodiment of the invention will be understood more clearly from the following description and the accompanying figures. These figures are given purely by way of an indication and in no way restrict the scope of the invention. Of these figures.

DETAILED DESCRIPTION OF THE INVENTION

Figure 1:
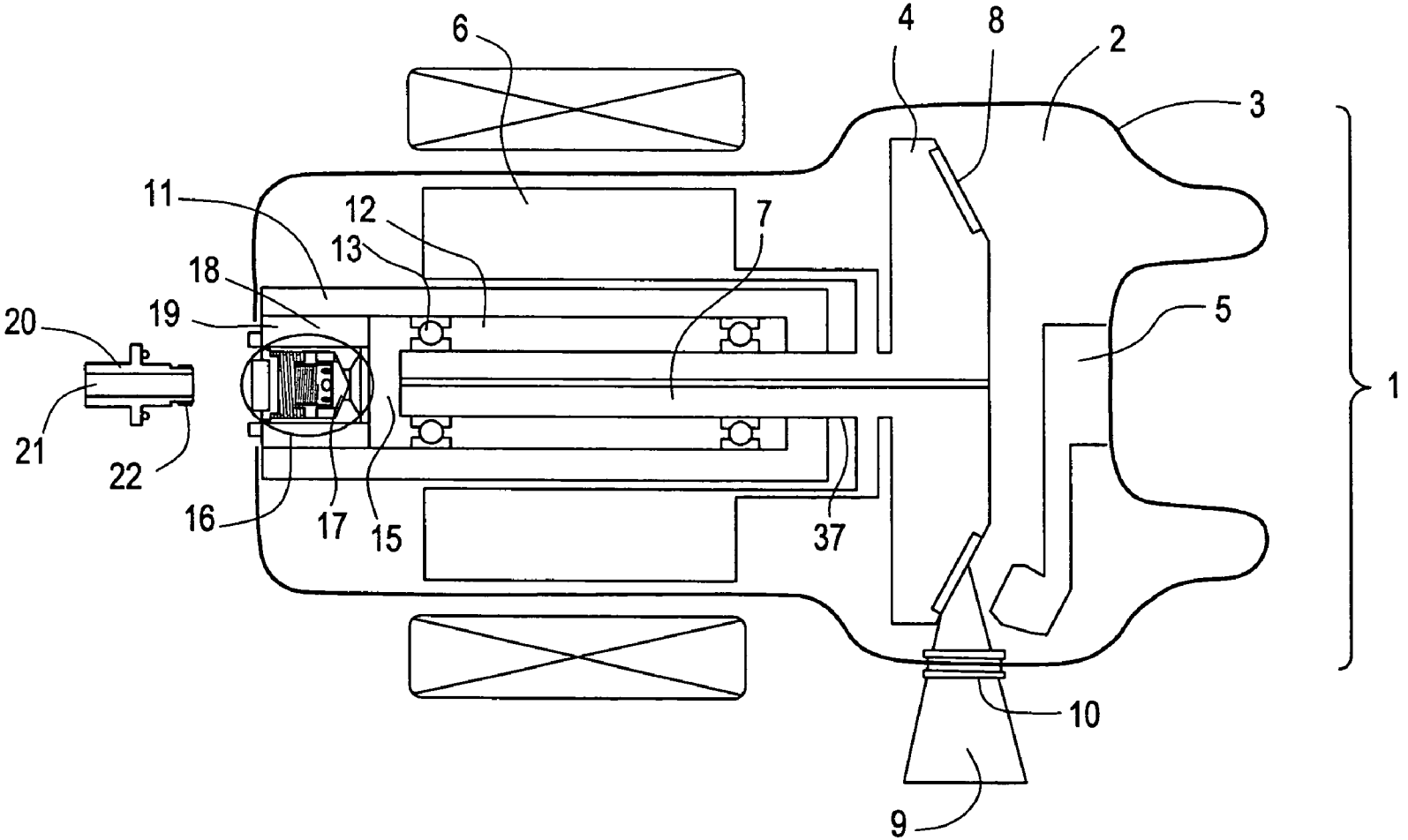
FIG. 1 is a schematic sectional view of an X-ray tube according to an embodiment of the invention.

In a first approach to the solution of handling the liquid, a hole or aperture that can be closed and opened is made in the chamber of the anode support. This aperture enables the chamber to be filled. The aperture is connected through a channel made in the support to the exterior of the enclosure. In this case, the liquid lubricant can be introduced under vacuum into the chamber at any time including after the construction of the tube.

However, this solution presents difficulties in the execution of the repetition of the filling/draining cycles. Indeed, it is desirable to maintain vacuum within the enclosure of the tube, and this must be done before, during and after the operations of filling or draining the liquid in the chamber. It is therefore desirable to remove or create a stemming of the tube corresponding to the aperture or else remove a classic part such as a plug that may be screwed on or soldered along the wall of the casing at the position of the support of the anode shaft. While these handling operations, which comprise unscrewing or unsoldering the plug, are achievable, they are difficult. Above all, they give rise to contact between the ambient air and the mixture of gallium, indium and tin and therefore entail risks of pollution of the chamber of the tube. This pollution ultimately stops the rotation of the anode.

Thus, the use of a bottle for gravity filling and the use of the stemming or of a simple plug for operations of setting up vacuum and closing the aperture still entail too many imperfections especially when obtaining a vacuum and placing the gallium-indium-tin mixture.

An embodiment of the invention proposes a device with two parts. A first part is a filler valve inserted at the inlet of a channel. The channel goes from the exterior of the wall of the tube to a support chamber of the anode shaft. The valve has a needle capable of shifting in a jacket, especially by means of a spring. The needle serves to plug the valve. As its second part, the device also has a removable sleeve that gets fixed to the needle. The sleeve serves to handle the needle inside the valve. Thus, through the sleeve, the needle, depending on its position inside the valve, opens or closes the hole or aperture and therefore permits or does not permit the access of the lubricating fluid into the chamber.

The sleeve has the additional characteristic of being hollow. The lubricant fluid may therefore flow inside the sleeve. Connecting a filler bottle under vacuum to the sleeve gives the result wherein the lubricant fluid flows under the optimum conditions of flow rate and vacuum tightness while at the same time being perfectly channeled. The assembly formed by the valve, sleeve and needle creates an integral system that is particularly simple to implement during the operations of pumping or filling lubricant liquid in the chamber. The sleeve, which is removable, can also be easily replaced, after a first use in contact with the gallium-indium-tin mixture, by another similar and totally unused sleeve. The filling thus becomes a fully industrial type of operation.

FIG. 1 shows an X-ray tube 1 according to an embodiment of the invention. The tube 1 has an enclosure 2. For example, the enclosure 2 is the one delimited by a wall 3 of the tube 1. The tube 1 also has a rotating anode 4. The rotating anode 4 is situated so as to be facing a cathode 5. Inside the enclosure 2 of the tube 1, there is a motor 6 for the rotational driving of the anode 4. The anode 4 has an anode shaft 7. The cathode 5 is situated so as to be facing an anode track 8. When the anode 4 is powered with high voltage, electrons are liberated from the cathode 5 and, under the effect of a powerful electrical field, they strike the anode track 8. Under the effect of this impingement, the anode track 8, which is formed by an X-ray emitting material, emits X-rays 9. The rays 9 exit from the tube 1 through a window 10 made in the wall 3. The window 10 is made, for example, of glass or an X-ray transparent material. It is air-tight. The enclosure 2 thus formed is put under vacuum conventionally, in particular through a suction hole (not shown) subsequently blocked by a stemming.

To keep the anode 4 rotating, the tube 1 is provided with an anode support 11. This support 11 is hollow and has a chamber 12. In the chamber 12, bearings or skids 13 maintain the anode 4 by the support 11. To resolve the problems of lubrication and of transportation of heat from the rotation of the anode 4, the chamber 12 may be filled with a gallium-indium-tin liquid alloy. The addition of a means, such as a channel or aperture or hole 15, leading firstly into the chamber 12 and secondly out of the tube 1 makes it possible to fill and/or pump and/or drain the chamber 12. This filling is possible after the construction of the tube 1 and increases the success rate of the filling operation. However, even in this case, the use of a bottle for the gravity filling of the chamber 12 and the use of a stem or a simple plug or stopper for operations comprising the setting up of a vacuum and a closure of the channel 15 still entail too many imperfections and risks of pollution of the tube 1 by oxides of the gallium-indium-tin mixture.

Figure 2:
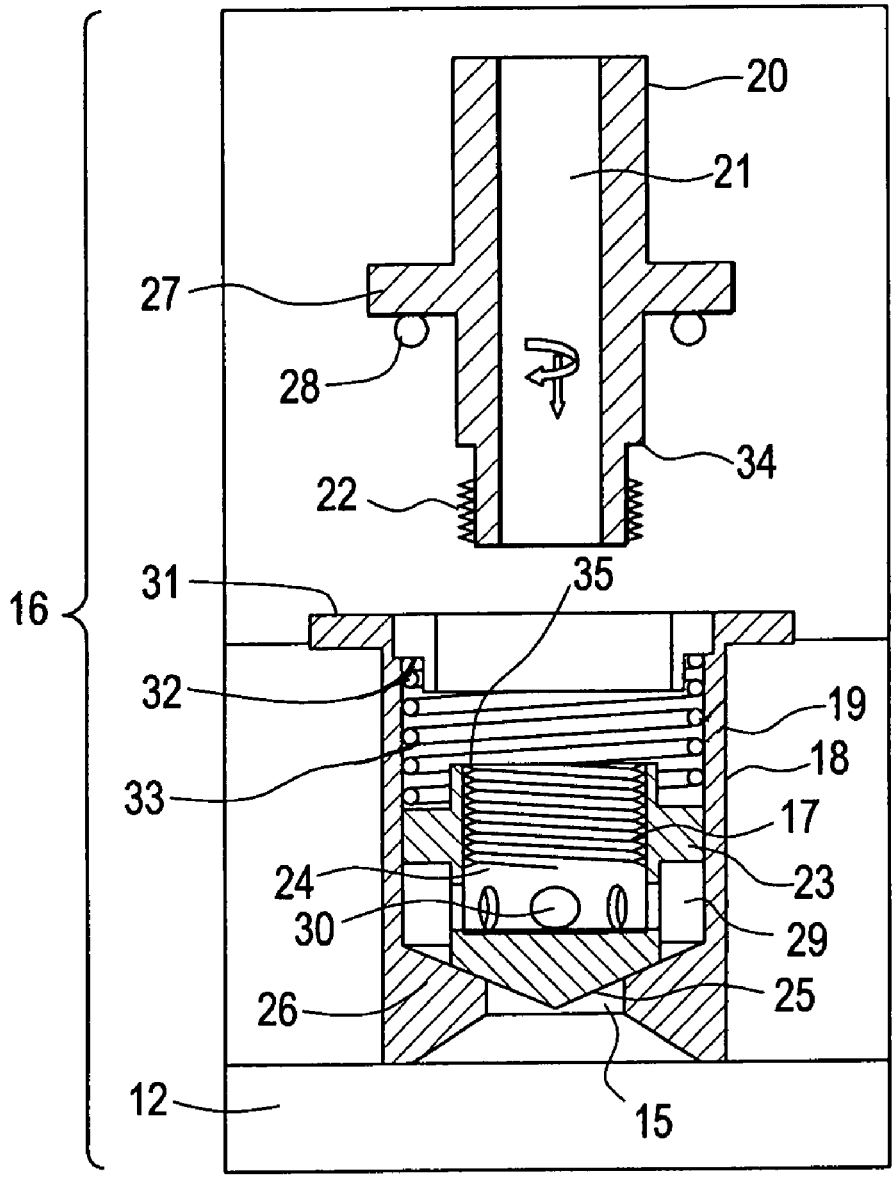
FIG. 2 is a detailed view of a valve according to an embodiment of the invention and its sleeve.

An embodiment of the invention overcomes this problem by providing the external end of the channel 15 of the chamber 12 with a valve 16. The valve 16, presented in detail in FIG. 2, has a needle 17 capable of moving in the valve 16. In one example, for this purpose, the needle 17 is guided in translation by being screwed into a jacket 18 of the valve 16. The jacket 18 is preferably screwed or even forced-fitted into a corresponding bore in the wall 19 of the valve 16. In a particular example, the jacket 18 is made of a highly resistant material based on titanium, zirconium and molybdenum. The needle 17 is made of a material based on tantalum, niobium, and titanium.

The valve 16 also has a sleeve 20. The sleeve 20 corresponds to a rather rectilinear tool but could also match, for example, a curved shape. The sleeve 20 is hollow and, to this end, has a cavity 21. In a variant, the sleeve 20 has a generally circular cylindrical shape, the cavity 21 being made on either side along a central axis of the circular cylinder. In order to get secured on the needle 17, the sleeve preferably has a thread 22 (which is male in this case) at one of its ends. The thread 22 is designed to engage in a complementary (female) thread 23 made inside the needle 17. Any other system for securing the needle to the sleeve can be contemplated, for example, in a variant using an elastic engaging mechanism.

The needle 17 is hollow and has a cavity 24. The cavity 24 is cylindrical, and is herein aligned with the thread 23. The cavity 24 opens out on the side of the needle 17 that receives the sleeve 20. On the other side of the needle 17, the cavity 24 is blocked by a conical or spherical head 25. The head 25, which is solid, may rest on a seat 26, namely a narrowed feature, of the channel 15 of the jacket 18 and thus block this hole when it is placed flat against this seat 26. The cavity 21 of the sleeve 20 communicates with the cavity 24 of the needle 17. The material used for the conical head 25 of the needle 17 is soft to match this seat 26 of the jacket 18 and at the same time highly resistant to corrosion by the indium-gallium-tin liquid.

To ensure that the vacuum is maintained when the needle 17 is removed, the sleeve 20 has, at approximately mid-height, a shoulder 27 formed by an extra thickness. This shoulder 27 serves to place an O-ring joint 28 against an upper rim of the valve 16. When the needle 17 is placed against the seat 26 with its head 25, the hole is blocked by the head of the needle. When the sleeve 20 is screwed into the needle 17, the O-ring joint 28 presses against the rim of the hole. The vacuum continues to be maintained in the chamber 12 so long as this support is not reached. If, thereafter, the sleeve continues to be manipulated, in this case screwed into the threads 23, the shoulder feature 27 and the O-ring joint 28 supported on the upper rim of the hole prevent the progress of the sleeve 20 toward the chamber 12. Consequently, the needle 17 is withdrawn from its position of support on the seat 26. The volume of the chamber 12 is then open on a volume 29 present between the needle 17 and the jacket 18. At the base of the needle, on the side opposite the one on which the threads 23 are present, holes such as 30 are made. The holes 30 place the space 29 in a state of communication with the cavity 24 of the needle and hence with the cavity 21 of the sleeve. When it is sought to fill the chamber 12 under vacuum with a liquid metal alloy of gallium-indium-tin, a vacuum is made in the cavities 21, 24 and 29 after the O-ring joint 28 has been placed on the valve 16 and before the needle 17 is removed. This vacuum is maintained by the presence of the joint 28.

To maintain the vacuum when the sleeve 20 of the valve 16 is not present, the jacket 18 will be provided with a ring 31, for example screwed into the upper rim of the jacket, near the opening of the valve 16. The ring 31 projects into the interior of the bore of the jacket 18 but allows the body of the sleeve 20 to pass through. The ring 31 forms an edge 32 in the bore of the jacket 18. A helical spring 33 is supported, firstly, beneath this edge 32 and, secondly, on the top of the needle 17. When the ring 31 is screwed (or glued) to the jacket 18, the spring 33 pushes the needle 17 back against the seat 26 and provides tight jointing. Otherwise, the needle 17 can be held against the seat by any other means: screwing, gluing or the like. The spring 33, or another mechanism when there is no sleeve 20, makes it possible to hold the needle 17 at the bottom of the jacket 18 against the inlet channel 15 of the chamber 12. This spring 33 can be coated with a titanium-based anti-corrosion deposit on a steel base or else it can be made of tungsten. By way of an indication, the height of the valve 16 is about 15 mm, the diameter of the inside of the jacket 18 is about 10 mm and the diameter of the needle 17 is about seven or eight mm.

It is possible to build the tube and set up vacuum therein before placing the lubricating liquid alloy through the valve 16 provided with its handling sleeve 20.

Figure 3:
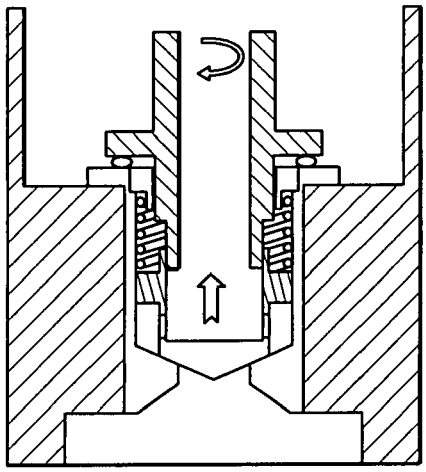
FIGS. 3 to 6 show an embodiment of the method for filling the chamber.

FIGS. 3 to 6 show the different tilling steps according to an embodiment of the method. In FIG. 3 the handling sleeve 20 is gradually introduced into the valve 16 until the two threads 22 and 23 are in contact. Then the sleeve 20 is made to turn by being screwed into the needle 17 until the O-ring joint 28 is supported on the jacket 18. In this state, the valve is positioned in its totality and the vacuum is still maintained in the chamber 12. A bottle of lubricant liquid is then placed on the other side of the sleeve 20. A feeder spout of the bottle is joined to the sleeve 20 in a tightly jointed way. Before the spout of the bottle is opened, vacuum is set up in the space of the cavity 21. This vacuum may be obtained by a vacuum pump connected to the sleeve, for example by a tee connection. One tip of this tee connection is connected to the sleeve 20. Two other tips of this tee connection have a lead-in clement each that is alternately opened and shut by a tap. Of the other two tips, one is connected to a vacuum pump and the other to a bottle of lubricant liquid.

Once this vacuum is obtained, the screwing of the sleeve 20 into the valve is continued so as to lift the needle 17 and its head 25 from the seat 26 of the channel 15. The operation takes place in compressing the spring 33 until a stop 34 of the sleeve rests against a stop 35 of the wall of the needle 17. During this screwing operation, to prevent the needle from rotating on itself, a groove may be made in the bore of the jacket 18. A stud formed by an extra thickness on the periphery of the needle 17 gets engaged in this groove. If necessary, the spring 33 through its two ends can play this rotation-preventing role. When the needle is raised again, the vacuum present in the cavities 21, 24 and 29 is linked with the vacuum present in the chamber 12.

Figure 4:
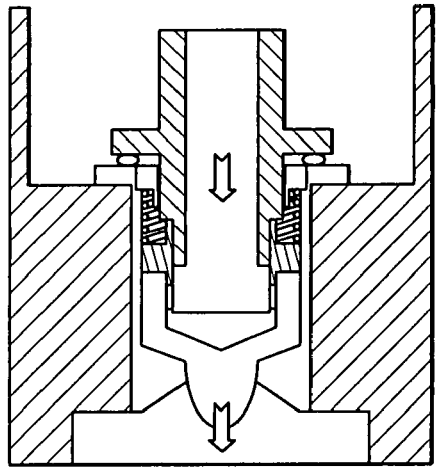
Figure 5:
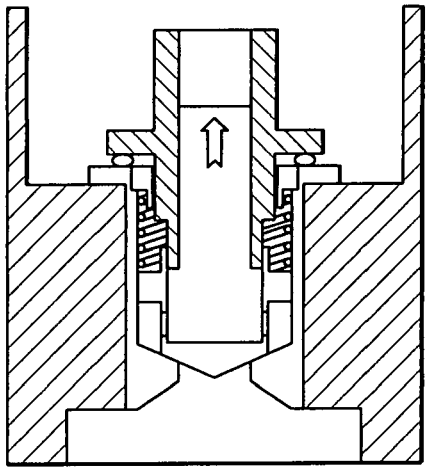

The device can even be used to set up a complementary vacuum in the chamber 12. Referring to FIG. 4, once this raising of the needle 17 has been obtained and once the vacuum is present, the lubricant liquid is introduced up to saturation into the chamber 12. For example, this introduction is done by gravity. The liquid spreads in the chamber 12 and coats the mechanical bearings 13. The quantity of liquid to be poured may be limited and may be planned in advance in the bottle. As a variant, in order to confine the lubricant in the chamber 12 and prevent it from spreading in the enclosure 2, the support 11 (FIG. 1) may have a joint 37 working by capillary action to prevent any leakage.

Once the filling is terminated, the sleeve 20 is screwed back in the reverse direction. The head 25 of the needle is then again placed against the seat 26. In this position, the volumes are isolated from one another, and the vacuum is still present in the bottle.

The operation then proceeds (FIG. 5) to a step for the draining by gravity of the liquid present in the volumes 29, 24 and 21. Draining is done by overturning the unit. The draining is possible through the apertures 30 of the needle. Preferably, no trace of gallium should be left within the valve 16. Then the bottle is plugged so that the liquid that it contains is isolated from the air. Then the sleeve 20 is removed from the valve 16. At this step in the method, the pressure of the air also contributes, as a complement to the action of the spring 33, to holding the head of the needle against the seat of the jacket 18.

Figure 6:
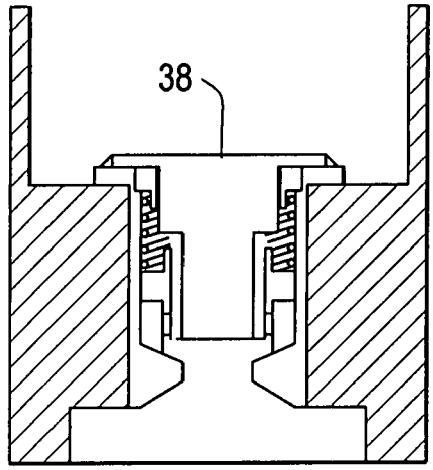

In FIG. 6, a plug or stopper 38 is introduced into the heart of the needle 17, occupying all the space left free by the removal of the sleeve 20. The plug 38 can then be soldered along the jacket 18. The material used in the composition of the plug 38 preferably improves the discharge of the heat released from the chamber 12 and the support 11 by heat conduction out of the enclosure 2. The plug 38 is also used to prevent any external pollution by residues of lubricants present in the valve. The plug 38 fills the cavity occupied by the needle 17.

When the lubricant liquid loses some of its properties within the chamber 12, it is replaced by inverting the steps described here above. In other words, the plug 38 is removed, and the sleeve 20 used earlier or a new sleeve, if the previous one is still soiled, is introduced into the valve 16. The liquid present in the chamber 12 is removed by gravity. Then, preferably after the valve has been plugged again, the sleeve 20 is drained (or the sleeve is changed again). A new filling operation can then take place with a new sleeve 20 if necessary.

In addition, while an embodiment of the invention has been described with reference to exemplary embodiments, it will be understood by those skilled in the art that various changes may be made in the function and/or way and/or result and equivalents may be substituted for elements thereof without departing from the scope and extent of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element or feature from another. Furthermore, the use of the terms a, an, etc. do not denote a limitation of quantity, but rather denote the presence of at least one of the referenced element or feature.

What is claimed is:

1. A radiation emission device comprising:

an enclosure in which the radiation is produced; in the enclosure a cathode, an anode situated so as to be facing the cathode and rotating on a shaft, and an anode shaft support;

the support comprising a chamber for holding the anode shaft;

the chamber having means for filling or pumping of the chamber with a lubricant fluid;

the means for filling or pumping being provided with an embedded valve comprising:

a plugging needle capable of shifting in the means for filling or pumping;

a removable sleeve getting secured to the needle;

the sleeve being hollow and being provided with means for handling the needle and opening and then closing the means for filling or pumping until the joint is supported by the enclosure; and the sleeve being provided with a joint and/or the needle being provided with a peripheral joint.

2. The device according to claim 1 wherein the needle has a thread corresponding to a thread of the sleeve; and the threads, once screwed into each other, enable the needle to be handled.

3. The device according to claim 1 wherein the valve has a jacket provided with a seat to receive the needle, and a spring in reaction against the jacket and pushing the needle so as to block the means for filling or pumping.

4. The device according to claim 2 wherein the valve has a jacket provided with a seat to receive the needle, and a spring in reaction against the jacket and pushing the needle so as to block the means for filling or pumping.

5. The device according to claim 3 wherein:

the needle is hollow and has a cavity, a conical or rounded solid head and a guiding part integral with the needle, shifting along the jacket;

the needle has one or more apertures in its wall the aperture or apertures enabling communication between the cavity and a space of the valve, this space being situated between the wall of the needle and the jacket; and the sleeve being hollow and has a cavity communicating with the cavity of the needle.

6. The device according to claim 4 wherein:

the needle is hollow and has a cavity, a conical or rounded solid head and a guiding part integral with the needle, shifting along the jacket;

the needle has one or more apertures in its wall the aperture or apertures enabling communication between the cavity and a space of the valve, this space being situated between the wall of the needle and the jacket: and the sleeve being hollow and has a cavity communicating with the cavity of the needle.

7. A method for placing a lubricant liquid in the chamber of a radiation emission device comprising:

engaging a sleeve in a needle;

applying a joint of the sleeve against a wall of a valve;

providing a vacuum in a cavity of the needle connected to a cavity of the sleeve while the joint is applied;

handling the sleeve again to move the needle away from means for filling or pumping: and causing a lubricant fluid to flow under vacuum into the chamber through two mutually connected cavities of the sleeve and the needle.

8. The method according to claim 7 comprising:

the sleeve is handled again to apply the needle to the means for filling or pumping;

the residual liquid is drained from the hollow parts of the needle and the sleeve; and the sleeve and its joint are removed from contact with the hole.

9. The method according to claim 7 wherein a plug is placed in the valve, in filling the cavity of the needle and blocking the head of the needle.

10. The method according to claim 8 wherein a plug is placed in the valve, in filling the cavity of the needle and blocking the head of the needle.

11. The method according to claim 7 wherein a plug is placed in the valve, the plug being formed by a heat-conducting inatenal.

12. The method according to claim 8 wherein a plug is placed in the valve, the plug being formed by a heat-conducting material.

13. The method according to claim 9 wherein a plug is placed in the valve, the plug being formed by a heat-conducting material.

14. The method according to claim 7 comprising:

a pumping/filling cycle is performed with the use of two different sleeves, one for the pumping and the other for the filling.

15. The method according to claim 8 wherein a plug is placed in the valve, the plug being formed by a heat-conducting material.

16. The method according to claim 9 wherein a plug is placed in the valve, the plug being formed by a heat-conducting material.

17. The method according to claim 11 wherein a plug is placed in the valve, the plug being formed by a heat-conducting material.

* * * * *